United States Patent [19]

Kershner

[11] 4,267,952

[45] May 19, 1981

[54] FOUR BAR LINKAGE FASTENER LOADER

[75] Inventor: Stuart D. Kershner, Bethany, Conn.

[73] Assignee: Olin Corporation, New Haven, Conn.

[21] Appl. No.: 89,644

[22] Filed: Oct. 29, 1979

[30] Foreign Application Priority Data

Nov. 4, 1978 [GB] United Kingdom ..... 43231/78

[51] Int. Cl.[3] ..... B25C 1/18; B25C 1/14

[52] U.S. Cl. ..... 227/9; 227/107

[58] Field of Search ..... 227/8, 9, 10, 107

[56] References Cited

U.S. PATENT DOCUMENTS 4,074,843 2/1978 Oesterle ..... 227/8

*Primary Examiner*—Paul A. Bell

*Attorney, Agent, or Firm*—William W. Jones; Paul J. Lerner

[57] ABSTRACT

A fastener loading device for a powder-actuated fastening tool comprises a ram-equipped, tubular fastener retaining member hingedly carried on legs secured to the tool receiver and forming therewith a four bar linkage, whereby the retaining member may be displaced from a first position, atop or alongside the receiver, to a second position, in communication with the barrel bore, whereat the retaining member ram may conveniently be utilized to insert the fastener into the barrel.

4 Claims, 1 Drawing Figure

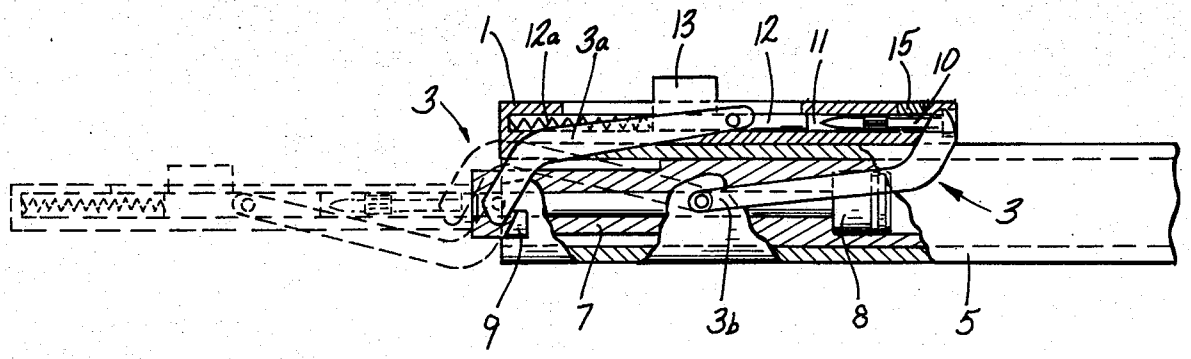
3
10
15
11
12
13
3a
12a
1
3
5
8
3b
7
9

FOUR BAR LINKAGE FASTENER LOADER

BACKGROUND AND SUMMARY OF THE INVENTION

The present invention relates to powder-actuated fastening tools and, more particularly, to a loading device for inserting a fastener in the barrel of such a tool.

Fastener driving tools actuated by the detonation of a blank piece cased or caseless ammunition are well known in the art. Such tools are of two types: "free flight", wherein the expanding gases produced by the detonated ammunition are applied directly against a fastener disposed in the tool barrel, and "piston", wherein a captive piston is disposed in the tool barrel intermediate the ammuniton and the fastener. In this latter type of tool, which is predominant in the marketplace, the piston must be reset from a forward or "fired" position, proximate the tool muzzle, to a rearward or "firing" position, proximate the tool breech, after each fastening. Often, this resetting is achieved by loading a fastener, head portion first, into the tool muzzle and then pressing against the protruding fastener nose or pointed end to force the entire fastener into the tool barrel. During this displacement, the fastener engages the piston, forcing the latter into the previously described "firing" position.

In most "piston" type tools, the piston is equipped with one or more "sealing rings" which slideably engage the bore wall of the tool barrel. These rings act as gas seals and further serve to retain the piston in a desired position within the barrel prior to discharge.

The fastener, likewise, is normally fitted with a washer or guide member which acts to retain the fastener prior to discharge and further serves to center and guide the fastener in its passage through the barrel during setting.

Insertion of a fastener into the tool is thus seen to require that considerable force be exerted against the fastener tip in order to overcome the resisting forces created by the piston rings and the fastener guide member. For this reason, a fastener is most commonly inserted by pressing the tool, with the protruding fastener tip against a hard surface, such as the workpiece. Such an insertion method is often inconvenient and further suffers in that the fastener may not be inserted beyond the point where the fastener tip is flush with the tool muzzle. Further insertion of the fastener, as may be required for the desired placement of the piston, necessitates the use of a separate pusher or ram rod, adding further to the inconvenience of the insertion procedure.

It is therefore, a primary object of the present invention to provide a safe, convenient and economical means of inserting a fastener to a desired position in the barrel bore of a powder-actuated fastening tool.

It is a further object to provide such an insertion means which may be incorporated in presently existing tools with minimal alteration thereof.

The above and other objects, as may hereinafter appear are achieved, in general, by a loading device comprising a ram-equipped, tubular fastener retaining member hingedly carried on legs secured to the tool receiver and forming therewith a four bar linkage, whereby the retaining member may be displaced from a first position, atop or alongside the receiver to a second position, in communication with the barrel bore, whereat the retaining member ram may conveniently be utilized to insert the fastener into the barrel.

The present invention may be more clearly understood by reference to the following detailed description, the appended claims and the drawing which is a fragmentary cross-sectional view of a preferred embodiment of the invention.

DESCRIPTION OF THE PREFERRED EMBODIMENT

A fastener loading device for use with a powder actuated tool comprises a tubular fastener retainer 1 hingedly carried on four legs 3, arranged in two pairs: a forward pair 3*a*, 3*a* and a rearward pair 3*b*, 3*b*. The legs 3*a*, 3*a*, 3*b*, 3*b* are hingedly attached to the tool receiver 5.

The legs 3, which are J-shaped for reasons which will be explained hereinafter, are all substantially congruent with the forward pair 3*a*, 3*a* and the rearward pair 3*b*, 3*b* being arranged in reverse manner. It is thus seen that the receiver 5, the retainer 1 and the legs 3 together comprise a classical four bar linkage which permits the forward and downward movement of the retainer 1, relative to the receiver 3, while at all times retaining the retainer 1 and the receiver 3 in a common plane, with their respective longitudinal axes parallel. As shown in the figure, the retainer 1 may be moved from a first position, atop or alternatively alongside the receiver 5, to a second position, in front of the tool barrel 7, along the indicated curved path. A pair of stop members 9 is provided on either side of the receiver 3 and act as abuttments to forward legs 3*a*, 3*a*, stopping movement of the linkage when the retainer 1 is in the desired position of alignment with the barrel 7. As seen in the figure, the curvature of the legs 3 is necessary to prevent mutual interference between the pairs which would stop movement of the retainer 1 before the desired second position was attained.

The retainer 1 includes, in its rearward end, a central axial blind bore 11 of a size to receive a fastener 10. Means, such as springs or magnets 15, are provided to releasably retain the fastener 10 within the bore 11. A push rod 12, which may incorporate a spring return means 12*a*, operated by an external grip 13, is provided in the retainer 1 to urge a fastener from within the bore 11.

In operation, the retainer 1 is placed in the first position and a fastener is inserted, point first, into the bore 11. The retainer 1 is then moved to the second position, whereat bore 11 is substantially coaxial with the bore of the barrel 7, and the push rod 12 is operated by means of a rearward displacement of the grip 13 to push the fastener 10 rearwardly into a desired loaded position in the tool barrel 7. The retainer 1 is now returned to the first position and loading of the fastener is complete.

It is to be noted that as the fastener is inserted into the barrel 7, the piston 8 is pushed backward into its desired rearward position.

Although the invention has been described and illustrated with reference to a specific, preferred embodiment, it is to be understood that various modifications may be made without departing from the spirit and contemplation of said invention which is intended to be limited in scope solely by the appended claims.

I claim:

1. An improved fastener loading device adapted for use with a powder-actuated tool comprising a substantially tubular retaining member adapted to receive a fastener therein, means for retaining a fastener within said retaining member, push rod means carried by said retaining member and adapted to overcome said retaining means and controllably eject a fastener from said retaining member, and connecting means hingedly connected to said retaining member and adapted to be connected to a powder-actuated tool, said connecting means comprising at least two legs, disposed in spaced relation along the axis of said retaining member.

2. In combination with a powder-actuated setting tool having a barrel with a bore, an improved fastener loading device, comprising a substantially tubular retaining member adapted to receive a fastener therein, means for retaining a fastener within said retaining member, push rod means carried by said retaining member and adapted to overcome said retaining means and controllably eject a fastener from said retaining member, and connecting means hingedly connecting said retaining member and said tool, said connecting means providing for movement of said retaining member from a first position alongside said tool to a second position in communication with said tool barrel bore, whereby a fastener may be inserted thereinto by operation of said push rod means, said connecting means comprising a pair of connecting members disposed in spaced relation along the axis of said retaining member, said retaining member, said connecting members and said tool together comprising a four bar linkage.

3. The combination of claim 2, wherein said connecting members each comprise a pair of substantially J-shaped legs, all of said legs being substantially congruent, the legs of one connecting member being arranged in reverse manner to the ones of the other.

4. The combination of claim 2, further comprising abuttment means on said tool adapted to engage at least one of said connecting members when said retaining member is in said second position.

* * * * *